US005351425A

United States Patent [19]

Knappe et al.

[11] Patent Number: 5,351,425

[45] Date of Patent: Oct. 4, 1994

[54] DISPLAY DEVICE AND PROCESSES FOR MAKING AND USING THE SAME

[75] Inventors: Robert T. Knappe, Castle Rock; John F. B. Prockter, Denver, both of Colo.

[73] Assignee: Apex Die & Box Company, Denver, Colo.

[21] Appl. No.: 904,986

[22] Filed: Jun. 26, 1992

[51] Int. Cl.[5] ..... G09F 1/12

[52] U.S. Cl. ..... 40/152.1; 40/155

[58] Field of Search ..... 40/124.1, 539, 155, 40/152.1; 229/92.8; 428/78, 201, 202; 248/459

[56] References Cited

U.S. PATENT DOCUMENTS

| | | | |
|---|---|---|---|
| 2,172,273 | 9/1939 | Chilcote | 40/152.1 |
| 2,380,076 | 7/1945 | Scheyer | 40/152.1 |
| 3,533,822 | 10/1970 | Bailey | 428/202 |
| 4,692,198 | 9/1987 | Borresen . | |
| 4,742,954 | 5/1988 | Shishido | 428/202 X |
| 4,779,792 | 10/1988 | Lombardo | 229/73 |
| 4,867,828 | 9/1989 | McIntyre . | |
| 5,019,202 | 5/1991 | Kawahata et al. . | |
| 5,026,584 | 6/1991 | Logan . | |
| 5,047,103 | 9/1991 | Abrams et al. . | |

FOREIGN PATENT DOCUMENTS

| | | | |
|---|---|---|---|
| 534445 | 1/1955 | Belgium | 40/152.1 |
| WO89/06192 | 7/1989 | World Int. Prop. O. | 40/152.1 |

*Primary Examiner*—Kenneth J. Dorner
*Assistant Examiner*—J. Bonifanti
*Attorney, Agent, or Firm*—Sheridan Ross & McIntosh

[57] ABSTRACT

A self-standing display device (10) formed from front (18) and rear (20) panels, and methods for making and using the same, are disclosed. The rear panel (20) includes an easel portion (12) which is foldable to provide standing support for the display device (10). The front (18) and rear (20) panels are interconnected by an adhesive coating (48) which can extend across the interface between the front (18) and rear (20) panels. Adhesion between the front panel (18) and the easel portion (12) is substantially prevented by barrier layer (46) which can be applied by lithographic printing.

16 Claims, 3 Drawing Sheets

DISPLAY DEVICE AND PROCESSES FOR MAKING AND USING THE SAME

FIELD OF THE INVENTION

The present invention relates generally to laminated products formed from materials such as paper, cardboard, paperboard or the like and, in particular, to such laminated products incorporating a detachable window or flap.

BACKGROUND OF THE INVENTION

In a number of applications, it is desirable to provide laminated products with a detachable window or flap. As used herein, the term "laminated" includes products formed from layers of materials adhesively interconnected, e.g., by mounting or other laminating technique. For example, display devices, such as point-of-purchase paperboard displays, may conveniently be provided with fold-out, easel flaps to support the display devices in an inclined position. In this manner, display devices can be shipped and stored in a substantially planar configuration and then the flaps can be deployed so that the devices are self-standing. Similarly, cardboard game pieces, for use in promotional sweepstakes, can have pop-out windows which a contestant removes to reveal prize information. In addition, packages such as cardboard boxes may have a flap which folds out to form or provide access to a spout to facilitate pouring of the package contents. Many other examples of laminated products having a window or flap are possible.

A problem associated with such products is that the process for producing the products is typically relatively complex, time-consuming and expensive. The case of paperboard display devices having fold-out easel flaps is illustrative. Such devices are commonly constructed from front and rear panels which are adhesively interconnected, e.g., by applying glue therebetween, to form the display device. Often, the front panel has a forwardly facing display surface and the rear panel includes an easel flap which can be deployed by folding the flap rearwardly to provide support. Alternatively, an easel may be formed separately and adhesively attached to the display device. As is readily appreciated, it is desirable to avoid adhesive attachment of the flap to adjacent portions of the display device so that the flaps can be easily deployed.

One known process for producing such paperboard display devices involves applying an adhesive across the extent of the interface between front and rear panels, wherein the rear panel includes a detachable easel flap, except for that portion of the interface where the easel flap is located. Accordingly, glue can be applied to portions of the rear panel around the easel flap in a pattern which complements the shape of the easel flap. Because glues are often tacky and highly viscous and therefore are poorly suited for certain high speed application techniques such as lithographic printing, the glue is commonly applied by silk-screening or a similar relatively slow and labor intensive process, thereby limiting production output and increasing production costs. Silk screening processes also result in usage of relatively large quantities of glue, further increasing production costs.

Manually coating panels with an adhesive by a process such as described above typically results in coating rates below about 120 panels per labor hour. Machines have been developed to mechanize the above-described process, including a machine known as the Automatan manufactured by Mirus Co. However, such machines are typically relatively expensive and are usually dedicated to particular coating applications, thereby increasing costs.

SUMMARY OF THE INVENTION

According to the present invention, a laminated product including a detachable flap or window and methods for making and using the same are provided. An adhesive barrier layer is provided to substantially prevent adhesion between the window or flap and adjacent portions of the laminated product. The barrier layer can be applied by various printing techniques including lithographic, gravure, letter press, rotary screen or flexographic printing. It is an advantage of the present invention that the barrier layer can be applied by lithographic printing or other, preferably high speed, application techniques, thereby enhancing efficiency, economy and production rates.

According to one aspect of the present invention, a laminated assembly is provided. The assembly includes first and second panels positioned in a superimposed relationship. The second panel includes a flap portion which is at least partially detachable from the remaining portion of the second panel. The flap portion may be totally removable from the assembly. An adhesive coating is disposed between the first and second panels and a barrier coating is disposed between the first panel and the flap portion, wherein the barrier coating resists adhesion between the flap portion and the first panel. The adhesive coating can be a layer of glue applied to the first panel and/or the second panel. The barrier coating is preferably formed from a material which can be applied by lithography or a similar high speed coating technique. The barrier coating can have a room temperature, application viscosity between about 100 centipoise and 600 centipoise, or even higher values for certain applications such as screen printing. Preferably, the barrier coating has a room temperature, application viscosity between about 100 centipoise and 400 centipoise for lithographic printing. More preferably, the barrier coating has a room temperature, application viscosity no greater than about 200 centipoise. In addition, the barrier coating may be formed from an ultraviolet or infrared radiation curable, heat curable, or electron beam curable material.

According to another aspect of the present invention, a method for constructing a laminated assembly including first and second layers is provided. The method includes the steps of applying a barrier coating which resists adhesion in a selected pattern on one side of one of the layers, applying an adhesive coating to one side of one of the layers, and positioning the first and second layers in a superimposed relationship. In addition, the method includes the step of forming a line of weakness in the first layer to define a detachable flap portion, wherein the flap portion and the barrier coating are arranged in a superimposed relationship in the assembly. The barrier coating can be applied by lithographically printing the barrier coating on one of the layers or by another printing technique. For example, the line of weakness can be formed by providing a continuous or perforated cut line in the first layer to define an outline of the flap.

According to a further aspect of the present invention, a method for use in displaying visual information is provided. The method includes the steps of providing a display device having front and rear sheets arranged in a face-to-face relationship, the front sheet including a display surface and the rear sheet including a fold-out easel portion, defined by a line of weakness, to provide support for the device in a standing position. The front and rear sheets are adhesively attached, wherein adhesion between the easel portion and the front sheet is substantially prevented by a barrier coating applied to the easel portion or the front sheet. The method includes the further steps of detaching the easel portion from a remaining portion of the rear sheet at the line of weakness, folding the easel portion rearwardly away from a plane of the rear sheet to an extended position wherein the easel portion is separated from the adhesive coating, and leaning the device against the easel portion in the extended position, wherein the easel portion supports the device such that the display surface is inclined for ease of viewing.

According to a still further aspect of the present invention, an assembly is provided. The assembly includes a first sheet of material having a line of weakness defining a fold-out easel portion. The fold-out easel portion is adapted for folding rearwardly relative to a plane of the first sheet so as to provide support for the assembly in a standing position. The assembly further includes a second sheet of material having a front exposed surface and a rear surface in registration with the front surface of the first sheet. An adhesive coating is applied to at least one of the surfaces of the first sheet or the second sheet to attach the sheets together. In addition, a barrier coating is applied to an area on either sheet corresponding to the easel portion such that adhesion between the easel portion of the first sheet and the second sheet is substantially prevented.

DETAILED DESCRIPTION OF THE PREFERRED EMBODIMENT

Figure 1:
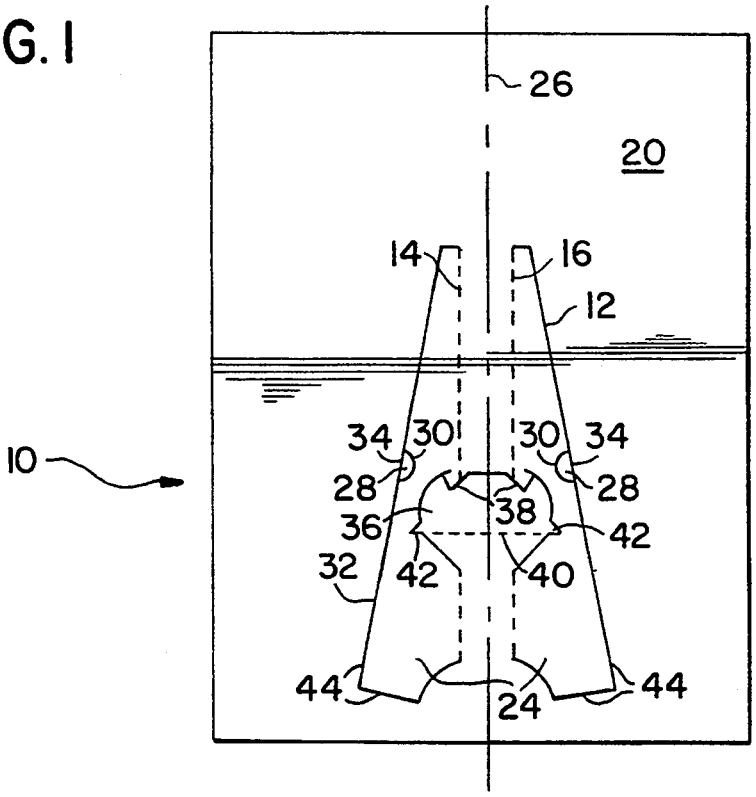
FIG. 1 is a back view of an apparatus constructed in accordance with the present invention.
Figure 2:
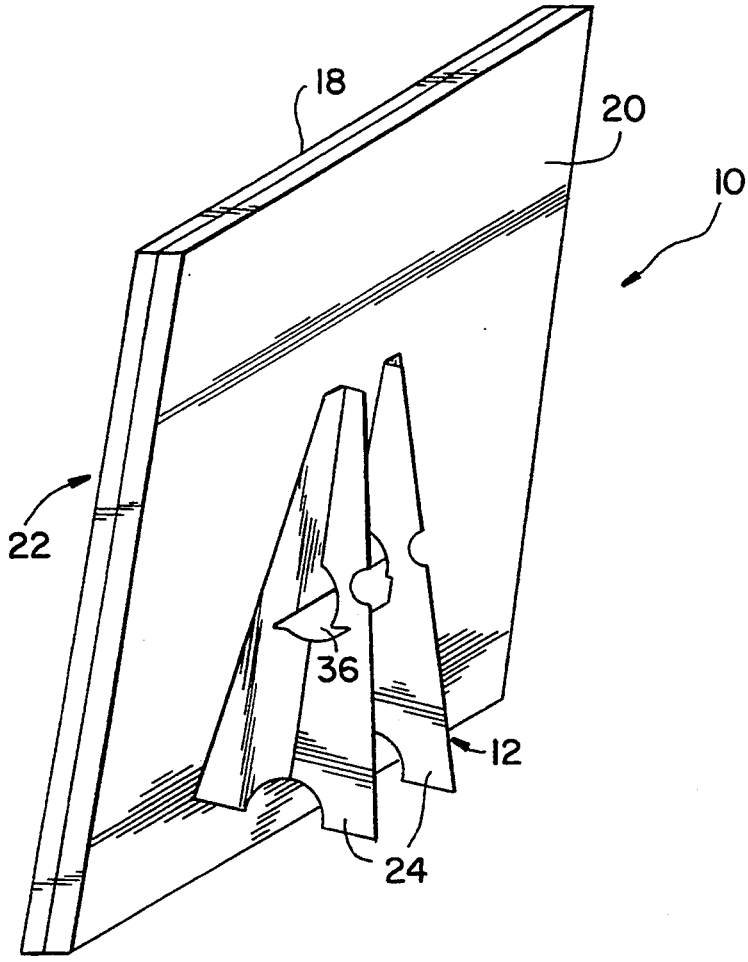
FIG. 2 is a perspective view of the apparatus of FIG. 1 with the easel in a deployed position.
Figure 3:
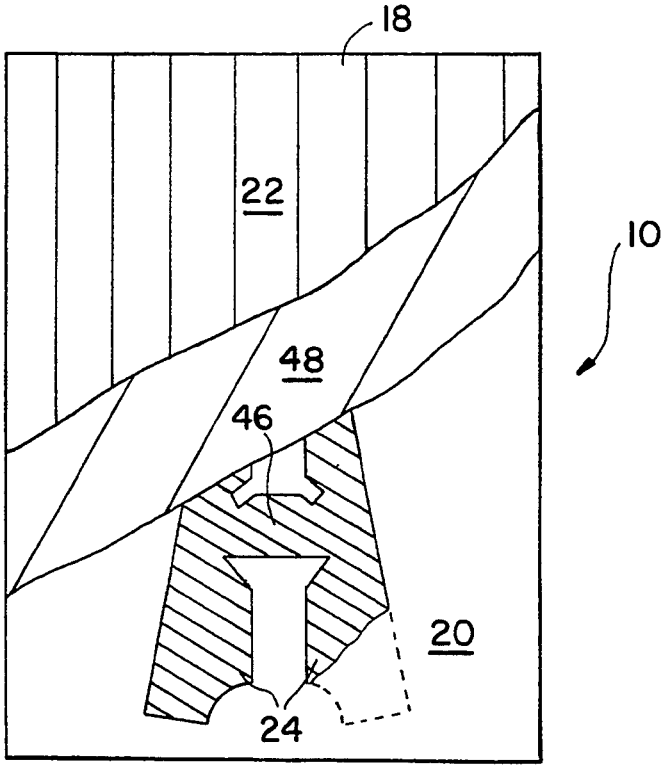
FIG. 3 is a cutaway front view of the apparatus of FIG. 1 with various layers partially removed for illustration purposes.

Referring to FIGS. 1–3, a device constructed in accordance with the present invention is generally identified by the reference numeral 10. Generally, the device 10 comprises a laminate constructed from panels, e.g., sheets or webs, and includes at least one detachable flap or window of any shape. The panels can be constructed from papers, polymers and/or other materials. Preferably, the panels are formed from fibrous materials such as paper, wood, cardboard, paperboard or other paper stock. In the illustrated embodiment, the device 10 comprises a display device including an extendible easel portion 12 which can be extended by folding the portion rearwardly from the device 10, e.g., by pivotably folding the portion 12 about axes 14 and 16, such that the easel portion 12 supports the device 10 in an inclined, standing position as shown in FIG. 2.

The device 10 includes front 18 and rear 20 panels arranged in a superimposed relationship. The panels 18 and 20 can be formed from a material such as cardboard, paperboard or the like which is sufficiently stiff so as to be suitable for use in a self-standing display device. In addition, the front panel 18 can be provided with a front, display surface 22 capable of receiving printed matter, e.g., promotional information. The illustrated panels 18 and 20 can be formed from 24 point paperboard which is suitable for a variety of self-standing display device applications. As will be understood upon consideration of the description below, the panels may be provided with a non-porous surface or coating to reduce absorption of materials applied thereto, thus reducing production costs.

The easel portion 12 can be provided as a portion of the rear panel 20. The easel portion 12 is positioned and shaped so that the device 10 can lean on the portion 12 for support when the portion 12 is extended. In this regard, it will be appreciated that many shapes and positions of the easel portion are possible. For example, a single, triangular flap, appropriately positioned, could be utilized to provide support for the device 10. The illustrated easel portion 12 includes a pair of generally triangular flaps 24 arranged in a mirror image relationship about a centerline 26 of the panel 20. This arrangement has been found to provide excellent standing stability for the device 10.

The illustrated easel portion 12 includes a number of other useful features. For example, the easel portion 12 includes tabs 28 to facilitate folding of the portion 12 to the extended position. The tabs 28 can comprise generally semi-circular, partially cut-out portions of the easel portion 12 sized to allow the user to insert a finger therethrough. The illustrated tabs 28 are defined by lines of weakness 30 through panel 20 extending nearly around tabs 28 and terminating a short distance before edges 32 of flaps 24. The lines 30 can, for example, be continuous or perforated cut-lines formed by die-cutting or other cutting technique. It will thus be appreciated that the tabs 28 can be pivotably folded about axis 34 such that the user can pull on tabs 28 or insert a finger underneath flaps 24 adjacent tabs 28 to facilitate folding of the easel portion 12 to an extended position.

The easel portion 12 also includes a flap 36 for securing the easel portion 12 in the extended position. As shown, the flap 36 has a generally semi-circular shape including a pair of generally triangular indentations 38. The flap 36 is foldable about axis 40 such that the indentations 38 can securingly receive corresponding indentations 42 of flaps 24 when the portion 12 is in the extended position. The flaps 24 and 36 are defined by lines of weakness 44 in or through panel 20, shown as solid lines in FIG. 1, which can be continuous or perforated cut-lines formed by die-cutting or other cutting technique.

The panels 18 and 20 are adhesively interconnected in a manner such that the easel portion 12 does not stick to the front panel 18. This can be accomplished according to the present invention by applying a barrier layer 46 which resists adhesion between the easel portion 12 and the front panel 18 as shown. The barrier layer 46 can be applied to either panel 18 or 20. Similarly, the adhesive coating 48 can be applied on either the front panel 18 or the back panel 20. It is an advantage of the present invention that the adhesive coating 48 can be applied across the extent of the interface between the panels 18 and 20 such that it is unnecessary to apply the adhesive coating 48 in a pattern so as to avoid bonding the easel portion 12 to the front panel 18. It will thus be appreciated that the adhesive coating 48 can be simply applied through spray coating, roller coating, or other high speed coating technique. Any suitable adhesive, for example, the adhesives identified by product codes OG2-37188 or 37117BX manufactured by Swift, can be utilized in accordance with the present invention. In a preferred embodiment, the adhesive is water soluble and is non-toxic upon curing.

The dimensions of the device 10 can vary broadly. The device 10 is preferably about 3 inches to 3 feet wide and 5 inches to 5 feet tall. The easel portion 12 is preferably between about $\frac{1}{4}$ and $\frac{3}{4}$ the height of the device 10 and preferably extends perpendicularly from the device 10 a distance of about 5% to 50% of the height of the device 10. In addition, the lower extremity of the easel portion 12 should be located a distance from the bottom of the device 10 of about 5% to 20% of the height of the device 10. The illustrated device 10 is about 18 inches wide and 30 inches tall. The easel portion 12 is about 19–20 inches tall and extends about 4–5 inches from the device when deployed. The easel portion 12 is positioned about 4–5 inches from the bottom of the device 10.

The barrier layer 46 is composed of a material which resists adhesion. Thus, for example, the barrier layer 46 can provide a hard, adhesive impermeable coating such that an adhesive applied thereto tends to bead up and adhere to the opposing material rather than to the barrier layer 46. Other desirable characteristics of the barrier layer 46 include the following. The barrier layer 46 can be curable, e.g., by ultraviolet or infrared radiation, heat or an electron beam, to ensure that the barrier layer 46 is cured quickly and completely thereby facilitating construction of the device 10. In addition, the barrier layer 46 can be suitable for application by a variety of printing techniques, including direct or offset techniques, such as screen, letterpress, lithographic, flexographic and gravure printing. Preferably, the barrier layer 46 is applicable by lithographic printing or similar high speed application techniques to enhance production speed and allow high speed construction without necessitating provision of an expensive machine dedicated to application of the barrier layer 46. It has been found that the barrier layer 46 can be lithographically printed in accordance with the present invention at rates greater than 3,500 prints per hour. In this regard, the barrier layer 46 should be formed of a material which has a low application viscosity, preferably below about 400 centipoise and more preferably below about 200 centipoise. Suitable barrier layer materials include various water-based emulsions and acrylic type materials such as, for example, MIRACURE J9312D and LATICOTE B7176X-1 manufactured by Pierce and Stevens.

Referring to FIGS. *6a–6e*, the device 10 can thus be constructed in an in-line process as follows. The panels 18 and 20 can be provided as pre-cut sheets or from a web of stock material. The barrier layer 46 material can be applied to the front 18 or rear panel 20 in a pattern corresponding to the shape of the easel portion 12 by lithographically or otherwise printing the barrier material on the panel. Thereafter, the panel can be cured, e.g., by irradiation with ultraviolet or infrared radiation, heat, or an electron beam. A coating 48 of glue can be applied to either the front 18 or rear 20 panel by spray coating, roller coating or other high speed coating technique, and then the panels 18 and 20 can be positioned in a superimposed relationship and pressed together by rollers, pressure plates or the like. The easel portion 12 can be cut, by die cutting, knife cutting or other technique, preferably before, but alternatively after the panels 18 and 20 are coated and attached together.

It will thus be appreciated that the device 10 can be quickly and simply constructed in accordance with the present invention without the need for an expensive machine dedicated to particular coating procedures. In this regard, it is noted that printing equipment utilized to apply the barrier layer 46 can be utilized for other printing applications. In addition, where the manufacturer does not desire to purchase additional equipment, the barrier layer 46 can be printed by a separate printing business in accordance with the present invention.

Figure 4:
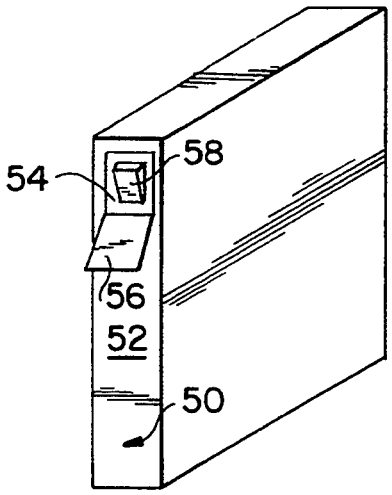
FIG. 4 is a perspective view of an apparatus constructed in accordance with an alternative embodiment of the present invention.
Figure 5:
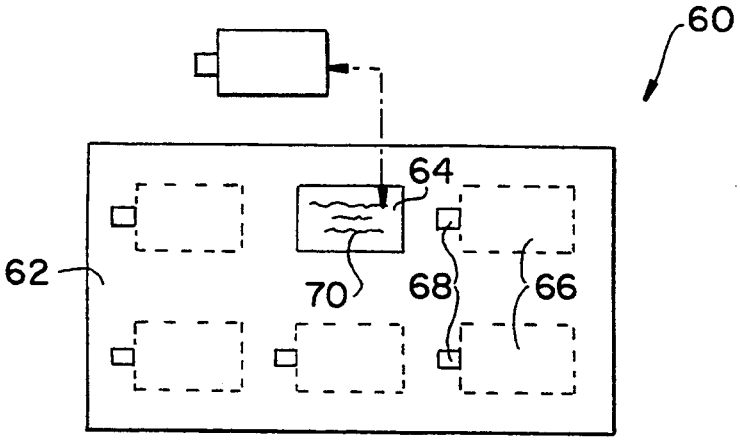
FIG. 5 is a front view of an apparatus constructed in accordance with a further alternative embodiment of the present invention.
Figure 6A:
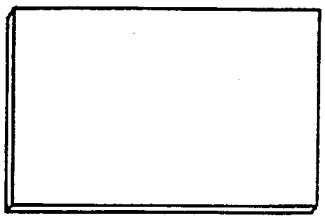
FIG. 6*a* is a perspective view of a panel.
Figure 6B:
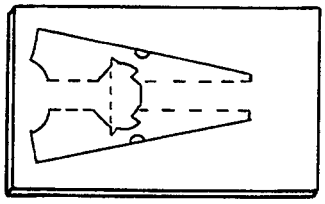
FIG. 6*b* is a perspective view of the panel of FIG. 6*a* after lines of weakness are formed.
Figure 6C:
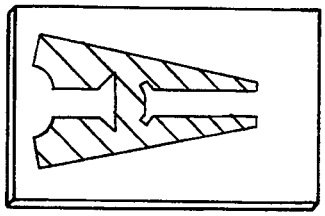
FIG. 6*c* is a perspective view of the panel of FIG. 6*a*. after application of a barrier coating.
Figure 6D:
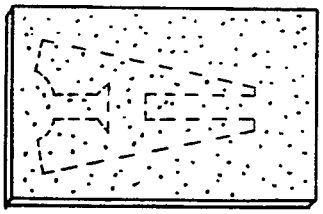
FIG. 6*d* is a perspective view of the panel of FIG. 6*a* after application of an adhesive coating.
Figure 6E:
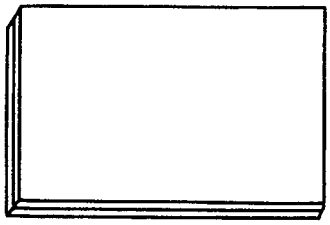
FIG. 6*e* is a perspective view of the panel of FIG. 6*a* after application of a second, superimposed panel.

Referring to FIGS. 4 and 5, alternative embodiments of the present invention are shown. FIG. 4 shows a box side panel portion 50 formed from front 52 and rear 54 panels wherein the front panel 52 is provided with a flap 56 to allow access to a pouring spout 58. It will be appreciated that a construction technique as described above may be utilized to form the side panel portion 50 so that the flap 56 can be easily opened without undesired adhesion between the flap 56 and rear panel 54. Similarly, FIG. 5 shows a gamepiece 60 formed from front 60 and rear 64 panels of fibrous material including a number of removable windows 66 and associated pull tabs 68. The gamepiece 60 can be used in connection with a sweepstakes wherein a contestant removes a window 66 to reveal prize information 70. The gamepiece 60 can be constructed using a technique such as described above. Other embodiments of the present invention could include, for example, gameboards or picture-books that have pop-up figures.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. An assembly, comprising:

a) a first panel;

b) a second panel positioned in a superimposed relationship with said first panel, said second panel including a flap portion which is at least partially detachable from a remaining portion of said second panel, said flap portion capable of moving between a retracted position wherein said flap portion is in substantially planar alignment with said remaining portion of said second panel and an extended position wherein said flap portion is disposed at an angle relative to said remaining portion of said second panel;

c) an adhesive coating, capable of being applied as a viscous fluid, disposed between said first and second panels, said adhesive coating bonding said first panel to said second panel wherein said first and second panels remain bonded by said adhesive coating when said flap is in said extended position; and d) a barrier coating, disposed between said first panel and said flap portion and extending substantially entirely across an interface between said first panel and said flap portion, said barrier coating resisting adhesion between said flap portion and said first panel.

2. The assembly of claim 1, wherein each of said first and second panels comprises a sheet of paper-stock.

3. The assembly of claim 1, wherein said assembly is a display device and said flap portion is foldable rearwardly from said second panel to provide support for said device.

4. The assembly of claim 1, wherein said flap portion is defined by a line of weakness to facilitate detachment of said flap portion from said remaining portion of said first panel.

5. The assembly of claim 1, wherein said flap portion is adapted to pivot relative to a plane of said second panel.

6. The assembly of claim 1, wherein said adhesive coating comprises glue applied to said first panel.

7. The assembly of claim 1, wherein said adhesive coating comprises glue applied to said second panel.

8. The assembly of claim 1, wherein said barrier coating comprises a material having a room temperature, application viscosity no greater than about 600 centipoise.

9. The assembly of claim 1, wherein said barrier coating comprises a material having a room temperature, application viscosity of no greater than about 200 centipoise.

10. The assembly of claim 1, wherein said barrier coating comprises an ultraviolet radiation curable material.

11. The assembly of claim 1, wherein said barrier coating comprises an infrared radiation curable material.

12. The assembly of claim 1, wherein said barrier coating comprises a heat curable material.

13. The assembly of claim 1, wherein said barrier coating comprises an electron beam curable material.

14. The assembly of claim 1, wherein said barrier coating comprises a lithographically printable material.

15. An assembly, comprising:

a) a first panel including a line of weakness defining a fold-out easel portion, said fold-out easel portion adapted for folding rearwardly relative to a plane of said first panel so as to provide support for said assembly in a standing position;

b) a second panel including a front exposed surface and a rear surface, wherein said rear surface of said second panel registers with a front surface of said first panel;

c) an adhesive coating applied to at least one of said front surface of said first panel and said rear surface of said second panel, said adhesive coating comprising a glue; and d) a barrier coating applied at an interface between said rear surface of said second panel and said easel portion, said interface being coextensive with said easel portion such that said barrier coating substantially prevents adhesion at said interface between said easel portion of said first panel and said second panel.

16. The assembly of claim 15, wherein said barrier coating comprises a lithographically printable material.

* * * * *